US007429901B2

(12) United States Patent
Kawanami

(10) Patent No.: US 7,429,901 B2
(45) Date of Patent: Sep. 30, 2008

(54) NON-RECIPROCAL CIRCUIT ELEMENT, COMPOSITE ELECTRONIC COMPONENT, AND COMMUNICATION APPARATUS

(75) Inventor: Takashi Kawanami, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 12/020,723

(22) Filed: Jan. 28, 2008

(65) Prior Publication Data

US 2008/0111648 A1 May 15, 2008

Related U.S. Application Data

(63) Continuation of application No. PCT/JP2006/312781, filed on Jun. 27, 2006.

(30) Foreign Application Priority Data

Jul. 28, 2005 (JP) ..... 2005-219549

(51) Int. Cl.
*H01P 1/36* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS 6,549,086 B2 4/2003 Kawanami
6,965,277 B2 11/2005 Kawanami
7,253,697 B2 * 8/2007 Soda et al. ..... 333/24.2
2006/0132255 A1 6/2006 Kawanami
2007/0046390 A1 * 3/2007 Soda et al. ..... 333/24.2

FOREIGN PATENT DOCUMENTS

JP 52-052546 A 4/1977
JP 2004-088743 A 3/2004
JP 2004-304434 A 10/2004

OTHER PUBLICATIONS

Official communication issued in the International Application No. PCT/JP2006/312781, mailed on Aug. 1, 2006.
Kawanami; "Non-reciprocal Circuit Element, Composite Electronic Component, and Communication Apparatus"; U.S. Appl. No. 12/020,701, filed Jan. 28, 2008.

* cited by examiner

*Primary Examiner*—Daniel D Chang
(74) *Attorney, Agent, or Firm*—Keating & Bennett, LLP

(57) ABSTRACT

An isolator includes first, second, and third center electrodes coupled in a high frequency manner with a ferrite member to which a direct-current magnetic field is applied by a permanent magnet. The first and third electrodes do not intersect with each other, and intersect with the second electrode in a mutually insulated state. Connection is established so that a magnetic field generated when a current flows from one end to the other end of the first electrode, and a magnetic field generated when a current flows from one end to the other end of the third electrode have the same phase and direction. A capacitor and a resistor are connected in parallel to the electrode, a capacitor is connected in parallel to the electrode, and a capacitor and a resistor are connected in parallel to the electrode. One end of the first electrode and the other end of the third electrode define balanced input ports, and the other end of the first electrode, one end of the second electrode, the other end of the second electrode, and one end of the third electrode define balanced output ports.

6 Claims, 7 Drawing Sheets

NON-RECIPROCAL CIRCUIT ELEMENT, COMPOSITE ELECTRONIC COMPONENT, AND COMMUNICATION APPARATUS

BACKGROUND OF THE INVENTION

1. Field of the Invention

The present invention relates to non-reciprocal circuit elements, and, in particular, to a two-port non-reciprocal circuit element, such as an isolator, for use in a microwave band, a composite electronic component including the element, and a communication apparatus including the element or the composite electronic component.

2. Description of the Related Art

Non-reciprocal circuit elements, such as isolators and circulators, have had a characteristic that they transmit a signal only in a predetermined particular direction but do not transmit the signal in the opposite direction. By using this characteristic, for example, isolators are used in transmitting circuit portions of mobile communication apparatuses, such as cellular phones.

As a non-reciprocal circuit element of the related art, Japanese Unexamined Patent Application Publication No. 2002-299915 discloses a three-port isolator in which center electrodes of an input port are balance-connected, and which can connect to a balanced output circuit without using a balun, or a hybrid. In addition, Japanese Unexamined Patent Application Publication No. 2004-282626 discloses a balanced-input balanced-output two-port isolator of a high isolation equivalent circuit that can be connected to a balanced circuit without using a balance-unbalanced converter.

The three-port isolator as described in Japanese Unexamined Patent Application Publication No. 2002-299915 has a narrow input matching band and requires input/output ports and center electrodes dedicated to terminating resistors. Thus, the three-port isolator has a problem reduced reliability since its circuit is complex and expensive.

In addition, the high-isolation two-port isolator as described in Japanese Unexamined Patent Application Publication No. 2004-282626 is not suitable for a transmitting apparatus because it has a narrow pass band and a large insertion loss, and it generates are large amount of heat. Consequently, this high-isolation two-port isolator has a problem of reduced reliability.

SUMMARY OF THE INVENTION

To overcome the problems described above, preferred embodiments of the present invention provide a reliable balanced-input balanced-output non-reciprocal circuit element having a simplified circuit configuration, a small insertion loss, a composite electronic component, and a communication apparatus.

A preferred embodiment of the present invention provides a non-reciprocal circuit element including a plurality of center electrodes coupled in a high frequency manner with a ferrite member to which a bias magnetic field is applied by a permanent magnet. The ferrite member is provided with first, second, and third center electrodes, the first and third center electrodes do not intersect with each other, and intersect with the second center electrode in a mutually insulated state. Connection is established so that a magnetic field generated when a current flows from one end to the other end of the first center electrode, and a magnetic field generated when a current flows from one end to the other end of the third center electrode have the same phase and direction. A first matching capacitor and a first terminating resistor are connected in parallel to the first center electrode, a second matching capacitor is connected in parallel to the second center electrode, and a third matching capacitor and a second terminating resistor are connected in parallel to the third center electrode, and one end of the first center electrode and the other end of the third center electrode define first balanced input/output ports, and the other end of the first center electrode, one end of the second center electrode, the other end of the second center electrode, and one of the third center electrode define second input/output ports.

In the non-reciprocal circuit element of this preferred embodiment, the first and third center electrodes do not intersect with each other, and intersect with the second center electrode in a mutually insulated state. A first matching capacitor and a first terminating resistor are connected in parallel to the first center electrode, a second matching capacitor is connected in parallel to the second center electrode, and a third matching capacitor and a second terminating resistor are connected in parallel to the third center electrode. Thus, a small lumped-constant isolator having a simplified circuit configuration is obtained. The isolator has a very small insertion loss and a wide band input matching characteristic.

In addition, connection is established so that a magnetic field generated when a current flows from one end to the other end of the first center electrode, and a magnetic field generated when a current flows from one end to the other end of the third center electrode have the same phase and direction. One end of the first center electrode and the other end of the third center electrode define first balanced input/output ports, and the other end of the first center electrode, one end of the second center electrode, the other end of the second center electrode, and one of the third center electrode define second input/output ports. Thus, a balanced-input balanced-output isolator is obtained without adding a balun.

In the non-reciprocal circuit element of this preferred embodiment, at least the second center electrode is wound at least one time around the ferrite member. The inductance of the second center electrode increases, and improved wide band input matching is obtained, thus facilitating matching with a pre-stage circuit, such as a power amplifier.

In addition, an electrical length of the second center electrode is substantially a quarter wavelength or a wavelength slightly less than the quarter wavelength. The inductance of the second center electrode is significantly increased, whereby resonance is achieved without actually connecting the second matching capacitor, thus eliminating deterioration of an insertion loss caused by the Q value of the second matching capacitor C2. Furthermore, improved wide band input matching is obtained, and matching with a pre-stage circuit, such as a power amplifier, is facilitated.

In addition, a composite electronic component according to another preferred embodiment of the present invention includes the non-reciprocal circuit element connected to outputs of a pair of amplifiers that operate with a phase difference of substantially 180°. Accordingly, outstanding electrical characteristics are obtained and the size of the apparatus is significantly reduced.

Furthermore, a communication apparatus according to another preferred embodiment of the present invention includes the non-reciprocal circuit element or the composite circuit component described above. Accordingly, outstanding electrical characteristics are obtained and the size of the apparatus is significantly achieved.

According to preferred embodiments of the present invention, electric characteristics of a two-port isolator can be used for a balanced signal without adding a balun, and size reduction, resource saving, and price reduction are achieved. In addition, insertion loss can be reduced to obtain a wide band input matching characteristic. In addition, reliability is greatly improved due to the reduced heat generation.

Other features, elements, characteristics and advantages of the present invention will become more apparent from the following detailed description of preferred embodiments of the present invention (with reference to the attached drawings).

BRIEF DESCRIPTION OF THE DRAWINGS

FIGS. 8A to 8F shows the center electrode assembly in the isolator of the second preferred embodiment, wherein FIG. 8A is a back view, FIG. 8B is a plan view, FIG. 8C is a front view, FIGS. 8D and 8E are side views, and FIG. 8F is a bottom view.

DETAILED DESCRIPTION OF THE PREFERRED EMBODIMENTS

Preferred embodiments of a non-reciprocal circuit element, composite electronic component, and communication apparatus of the present invention are described below with reference to the accompanying drawings.

First Preferred Embodiment

Figure 1:
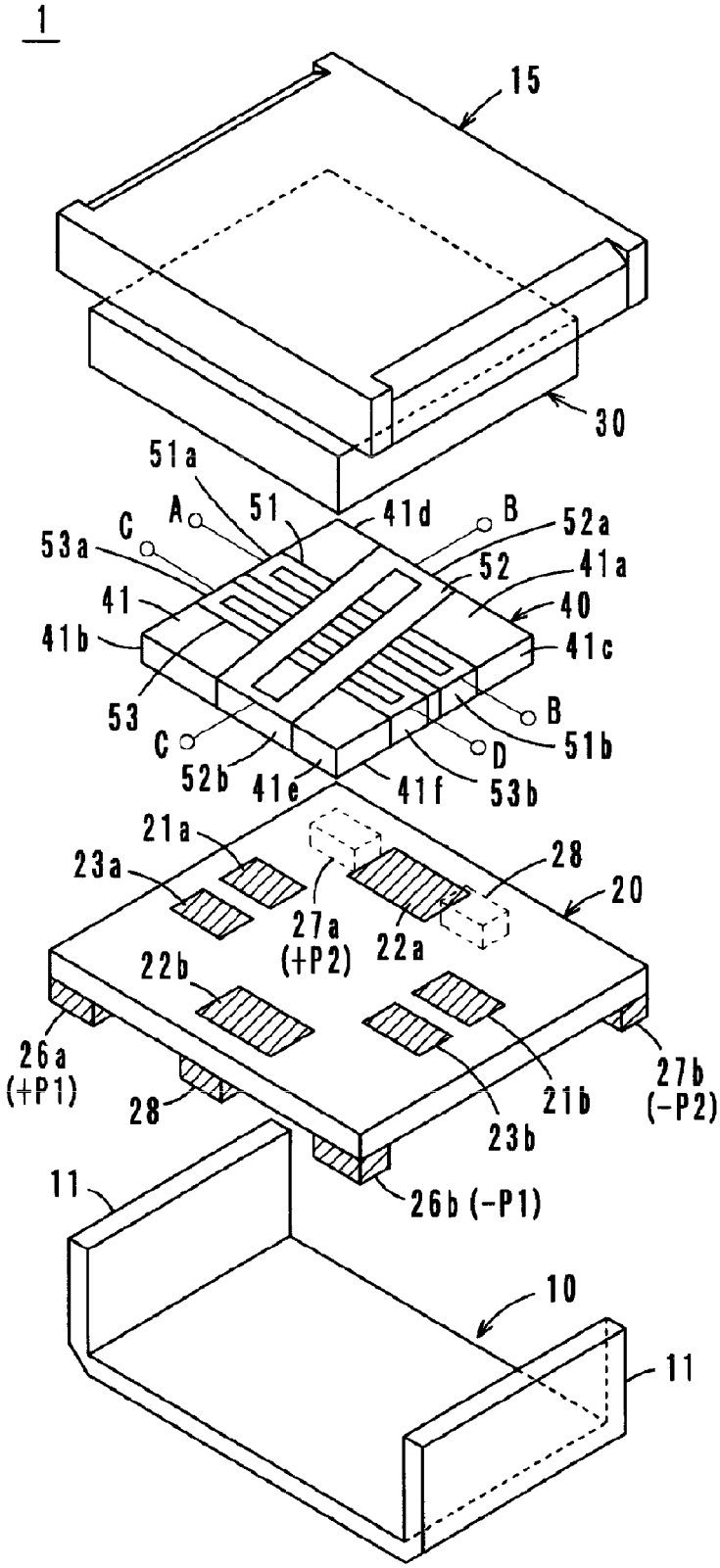
FIG. 1 is an exploded perspective view showing a two-port isolator according to a first preferred embodiment of the present invention.

FIG. 1 is an exploded perspective view of a two-port isolator 1 as a first preferred embodiment of a non-reciprocal circuit element of the present invention. The two-port isolator 1 preferably is a lumped-constant isolator, and includes a metal case 10, a metal cap 15, a circuit substrate 20, a permanent magnet 30, and a center electrode assembly 40. The center electrode assembly 40 includes a ferrite member 41 and center electrodes 51, 52, and 53, as described in detail below.

The metal case 10 and the cap 15 are preferably made of a ferromagnetic material, such as soft iron, preferably having a thickness of approximately 0.05 to approximately 0.25 mm, for example, and have a frame shape surrounding the circuit substrate 20, the center electrode assembly 40, and the permanent magnet 30. Side portions 11 of the metal case 10 are connected to side surfaces of the cap 15 in a conductive manner, and combine with the permanent magnet 30 to form a magnetic circuit. In addition, the metal case 10 and the cap 15 preferably are first plated with copper having a thickness of approximately 0.1 μm to approximately 100 μm and are then plated with silver having a thickness of approximately 1 μm to approximately 5 μm, for example, whereby rust prevention is improved, and a conductor loss due to an eddy current generated by high frequency flux and a conductor loss due to a ground current are reduced.

The permanent magnet 30 applies a direct-current bias magnetic field in a substantially perpendicular direction to a main surface 41*a* of the ferrite member 41. As shown in the equivalent circuit of the center electrode assembly 40 shown in FIG. 2, in a high frequency manner, through the ferrite member 41, a first center electrode 51 (inductor L1) and a second center electrode 52 (inductor L2) are coupled and a third center electrode 53 (inductor L3) and the second center electrode 52 are coupled.

Regarding the permanent magnet 30, strontium, barium, and lanthanum-cobalt ferrite magnets preferably are used. These are also dielectric materials. Thus, in the permanent magnet 30, high frequency magnetic flux can be distributed with a very small loss. Accordingly, even if the permanent magnet 30 is disposed in proximity to the center electrodes 51, 52, and 53, electric characteristics, such as an insertion loss, are not substantially deteriorated. In addition, since the permanent magnet 30 and the ferrite member 41 have similar temperature characteristics, a temperature characteristic for an isolator is improved.

The center electrode assembly 40 is formed by forming the first center electrode 51, the second center electrode 52, and the third center electrode 53, which are electrically insulated from one another, on the first main surface 41*a* of the ferrite member 41, which preferably has a substantially rectangular parallelepiped configuration. The first center electrode 51 and the third center electrode 53 do not intersect with each other, and intersect with the second center electrode 52 in a mutually insulated state.

Specifically, one end 51*a* of the first center electrode 51 is arranged on a first side surface 41*b* of the ferrite member 41, and the other end 51*b* thereof is arranged on a second side surface 41*c*. The one end 51*a* is called an electrode A, and the other end 51*b* is called an electrode B. One end 52*a* of the second center electrode 52 is arranged on a third side surface 41*d* of the ferrite member 41, and the other end 52*b* thereof is arranged on a fourth side surface 41*e*. The one end 52*a* is called an electrode B, and the other end 52*b* is called an electrode C. One end 53*a* of the third center electrode 53 is arranged on the first side surface 41*b* of the ferrite member 41, and the other end 53*b* thereof is arranged on the second side surface 41*c*. The one end 53*a* is called an electrode C, and the other end 53*b* is called an electrode D.

On the main surface 41*a* and side surfaces 41*b* to 41*e* of the ferrite member 41, as the center electrodes 51, 52, and 53, metal plates and foil made of copper or copper alloy, or metal plates and foil plated with silver or silver alloy are preferably provided. In addition, the center electrodes 51, 52, and 53 may be formed as film electrodes made of silver or copper thick film or thin film, and may be formed into predetermined shapes with high accuracy by using a processing technology such as printing, transfer, lithography, or etching. As the ferrite member 41, YIG ferrite or other suitable ferrite material may be used.

Figure 3:
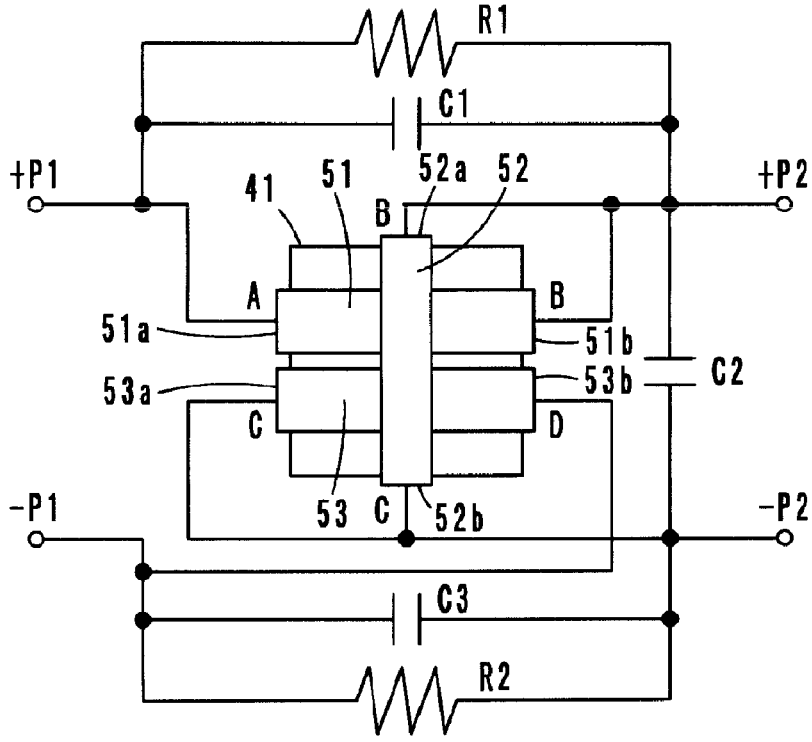
FIG. 3 is an equivalent circuit diagram of the isolator of the first preferred embodiment of the present invention.
Figure 4:
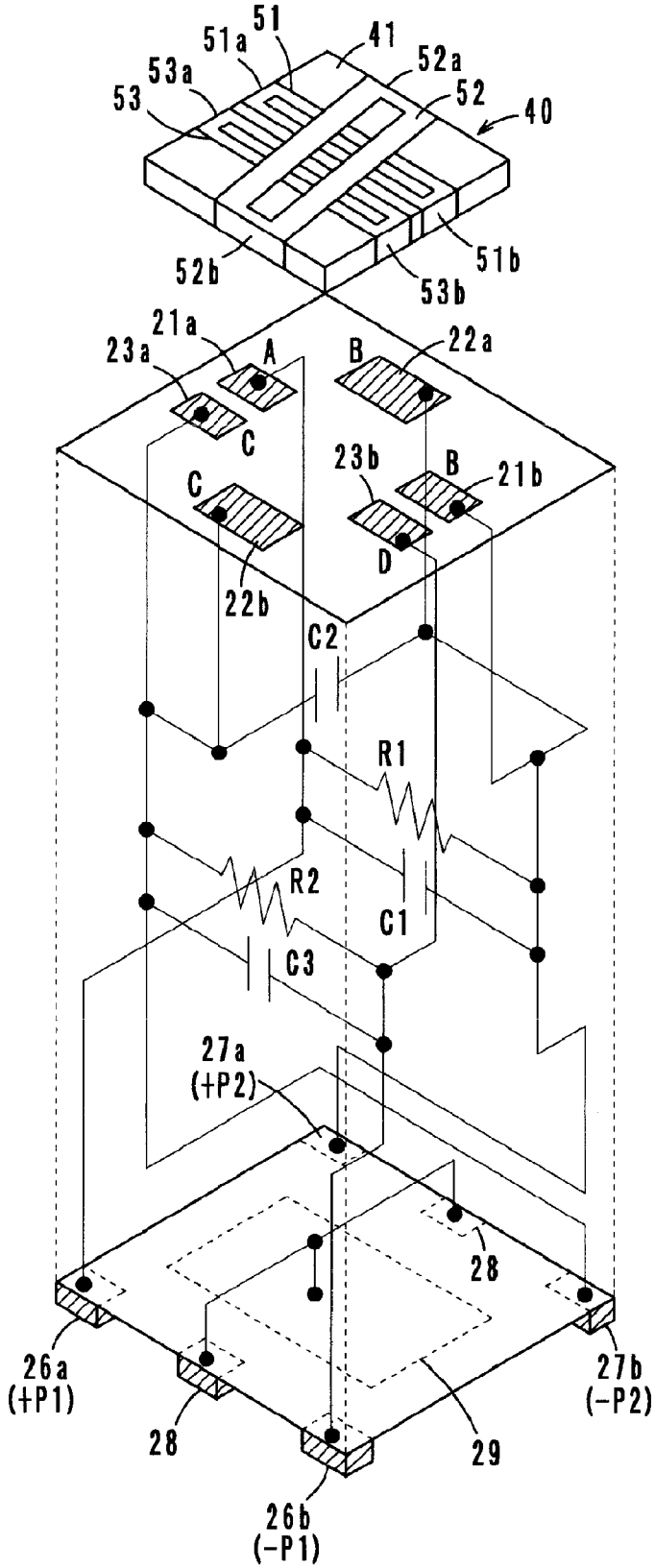
FIG. 4 is a block diagram showing a circuit configuration in a circuit substrate included in the isolator according to the first preferred embodiment of the present invention.

The circuit substrate 20 is a multilayered substrate formed by forming predetermined electrodes on a plurality of dielectric sheets, laminating the sheets, and sintering the laminated sheets. In the circuit substrate 20, as shown in FIGS. 3 and 4, matching capacitors C1, C2, and C3, and terminating resistors R1 and R2 are included. On a top surface of the circuit substrate 20, terminal electrodes 21*a*, 21*b*, 22*a*, 22*b*, 23*a*, and 23*b* are formed, and, on a bottom surface thereof, external connecting terminal electrodes 26*a*, 26*b*, 27*a*, 27*b*, 28, and a ground electrode 29 are provided.

As the circuit substrate 20, a composite substrate is used which includes a material obtained by firing a mixture of glass and alumina which can be simultaneously fired with a thick film electrode and another dielectric, resin, glass, and another dielectric. For inside and outside electrodes, a thick film of silver and silver alloy, a thick copper film, a copper foil, etc., may be used. In particular, preferably, the external connecting terminal electrodes 26*a*, 26*b*, 27*a*, 27*b*, 28 preferably are plated with nickel having a thickness of about 0.1 μm to about 5 μm and are then plated with gold having a thickness of about 0.01 μm to about 1 μm, for example. This is to prevent rust, improve solder-corrosion resistance, and prevent a decrease in the strength of the solder bonding itself due to a weak alloy layer produced by diffusion of metal that is unnecessary for soldering.

The external connecting terminal electrodes 26*a*, 26*b*, 27*a*, 27*b*, 28 are projected by increasing the thickness of the thick film electrode, and the bottom of the case 10 substantially the same thickness as the external connecting terminal electrodes 26*a*, 26*b*, 27*a*, 27*b*, 28, whereby soldering to a mounting circuit substrate is improved.

Figure 2:
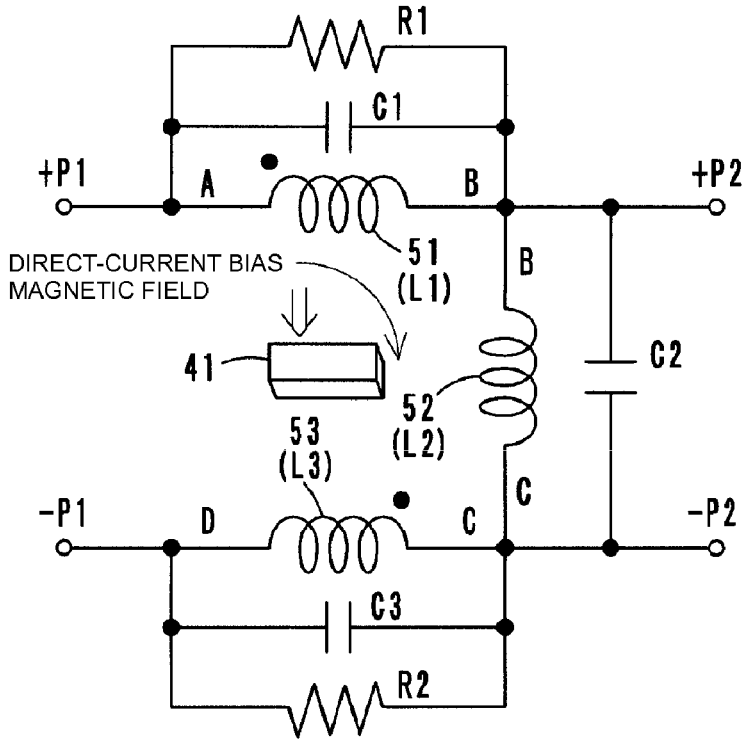
FIG. 2 is an equivalent circuit diagram of a center electrode assembly included in the isolator of the first preferred embodiment of the present invention.

A circuit configuration of the isolator 1 is described. FIG. 2 shows an equivalent circuit of the isolator 1 in which a portion of the center electrode assembly 40 is represented by an equivalent circuit. FIG. 3 shows an equivalent circuit of the isolator 1 in which the portion of the center electrode assembly 40 is shown in a similar manner to its physical shape. FIG. 4 shows an internal circuit configuration of the circuit substrate 20.

Specifically, connection is established so that a magnetic field generated when a current flows from the one end 51*a* (electrode A) of the first center electrode 51 to the other end thereof, and a magnetic field generated when a current flows from the one end 53*a* (electrode C) of the third center electrode 53 to the other end thereof have the same phase and direction. The first matching capacitor C1 and the first terminating resistor R1 are connected in parallel to the first center electrode 51, the second matching capacitor C2 is connected in parallel to the second center electrode 52, and the third matching capacitor C3 and the second terminating resistor R2 are connected in parallel to the third center electrode 53.

The one end 51*a* (electrode A) of the first center electrode 51 and the other end 53*b* (electrode D) of the third center electrode 53 respectively define balanced input ports +P1 and −P1, and the other end 51*b* (electrode B) of the first center electrode 51 and the one end 52*a* (electrode B) of the second center electrode 52 define balanced output ports +P2. In addition, the other end 52*b* (electrode C) of the second center electrode and the one end 53*a* (electrode C) of the third center electrode 53 are used as balanced output ports −P2.

In other words, as shown in the block diagram of FIG. 4, the external connecting terminal electrode 26*a*, provided on the bottom surface of the circuit substrate 20, functions as the balanced input port +P1, and the terminal electrode 26*b* functions as the balanced input port −P1. In addition, the terminal electrode 27*a* functions as the balanced output port +P2, and the terminal electrode 27*b* functions as the balanced output port −P2.

In addition, the terminal electrodes 21*a* and 21*b* provided on the top surface of the circuit substrate 20 are respectively connected to the one end 51*a* and the other end 51*b* of the first center electrode 51, and the terminal electrodes 22*a* and 22*b* are respectively connected to the one end 52*a* and the other end 52*b* of the second center electrode 52. The terminal electrodes 23*a* and 23*b* are respectively connected to the one end 53*a* and the other end 53*b* of the third center electrode 53.

In the isolator 1 having the above-described configuration, when balanced signals (differential signals having a phase difference of 180°) are input to the balanced input ports +P1 and −P1, a current flows in the first center electrode 51, and a high frequency magnetic field is generated by the ferrite member 41. Based on the high frequency magnetic field, a current flows in the second center electrode 52, which is magnetically coupled with the first center electrode 51, and a magnetic field generated by the first center electrode 51 and a magnetic field generated by a current flowing in the third center electrode 53 are coupled in a direction in which both enhances each other. This transmits the balanced signals to the balanced output ports +P2 and −P2.

The first and third center electrodes 51 and 53 do not intersect with each other, and intersect with the second center electrode 52 in a mutually insulated state. The first matching capacitor C1 and the first terminating resistor R1 are connected in parallel to the first center electrode 51, the second matching capacitor C2 is connected in parallel to the second center electrode 52, and the third matching capacitor C3 and the second terminating resistor R2 are connected in parallel to the third center electrode 53. Thus, this enables a small lumped-constant isolator having a simplified circuit configuration to be provided. This lumped-constant isolator has a small insertion loss and a wide band input matching characteristic.

Figure 5:
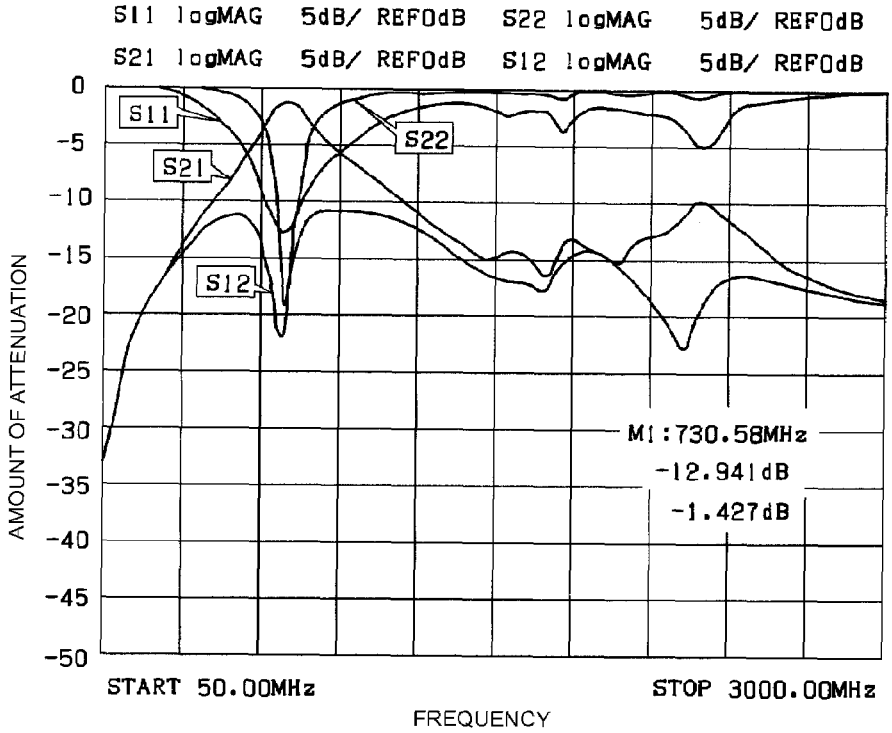
FIG. 5 is a graph showing S-parameter characteristics in a case in which reverse phase signals are applied to two balanced input ports of the isolator of the first preferred embodiment of the present invention.

FIG. 5 shows S-parameter characteristics when a signal-source-and-load in opposite phase (balanced, differential, balance) is connected to the two balanced input ports of the isolator 1 and a signal-source-and-load in opposite phase (balanced, differential, balance) is connected to the two balanced output ports. As shown in FIG. 5, in an operating frequency band from 700 MHz to 800 MHz, a forward transmission characteristic (S21) is large, and the signal is transmitted with a very small loss. A reverse transmission characteristic (S12) is small, no signal is transmitted, and attenuation is large. Therefore, the isolator 1 has outstanding isolation for a reverse signal.

Figure 6:
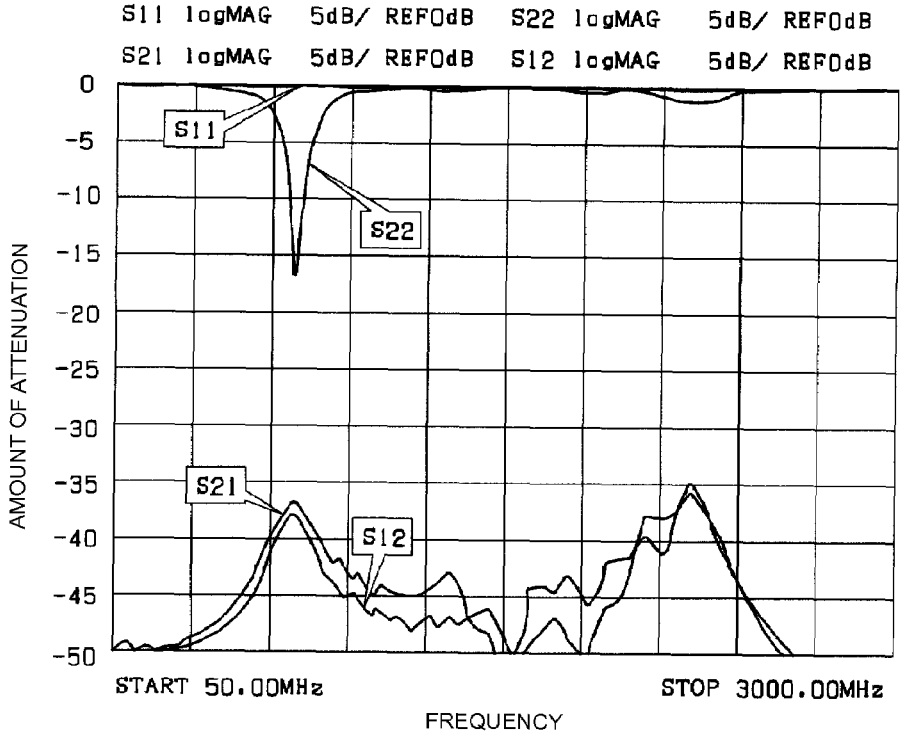
FIG. 6 is a graph showing S-parameter characteristics in a case in which identical phase signals are applied to the two balanced input ports of the isolator of the first preferred embodiment, with the ports connected to each other.

FIG. 6 shows S-parameter characteristics when an in-phase (unbalanced, unbalance) signal source is connected to the two balanced input ports of the isolator 1, with the two balanced input ports connected to each other, and a signal-source-and-load in opposite phase (balanced, differential, balance) is connected to the two balanced output ports. At this time, the two balanced input ports are connected to each other. As shown in FIG. 6, in a wide frequency band from 50 MHz to 3000 MHz, a forward transmission characteristic (S21) has a small value of not greater than about −30 dB, thus indicating a state in which no signal is transmitted. Similarly, also regarding a reverse transmission characteristic (S12), no signal is transmitted and attenuation is large.

As is clear from comparison between FIGS. 5 and 6, the isolator 1 has an outstanding balance function, that is, a common mode rejection ratio.

In addition, connection is established so that a magnetic field generated when a current flows from the one end 51*a* (electrode A) of the first center electrode 51 to the other end thereof, and a magnetic field generated when a current flows from the one end 53*a* (electrode C) of the third center electrode 53 to the other end thereof have the same phase and direction. The one end 51*a* (electrode A) of the first center electrode 51 and the other end 53*b* (electrode D) of the third center electrode 53 define balanced input ports +P and −P1, respectively. The other end 51*b* (electrode B) of the first center electrode 51 and the one end 52*a* (electrode B) of the second center electrode 52, and the other end 52*b* (electrode C) of the second center electrode 52 and the one end 53*a* (electrode C) of the third center electrode 53 define balanced output ports +P2 and −P2. Thus, a balanced-input balanced-output isolator is obtained without adding a balun.

As the capacitances of the matching capacitors C1, C2, and C3, values that substantially resonate with the center electrodes 51, 52, and 53 and the operating frequency are selected. When the isolator 1 is used in a 50-Ω circuit, as each terminating resistor R1 or R2, a value of substantially 50Ω is selected. However, a value of approximately 25Ω to approximately 100Ω is appropriate depending on the inductances of the center electrodes 51, 52, and 53.

As the second center electrode 52 and the second matching capacitor C2, elements having high Q values, that is, low losses, are preferably used. When the Q values decrease, an insertion loss increases. In the first center electrode 51 and the first matching capacitor C1, and the third center electrode 53 and the third matching capacitor C3, an insertion loss does not increase, even if the Q value is low. However, an extremely low Q value decreases an isolation bandwidth.

In the first preferred embodiment, the circuit substrate 20 preferably is a multilayer dielectric substrate. This enables the circuit substrate 20 to include a network therein, such as capacitors and inductors, so that the size and thickness of the isolator 1 are significantly reduced. Since connection between circuit elements is established in the substrate, the reliability thereof is improved. The circuit substrate 20 is not required to be multilayered, and may be a single layer substrate. With a single layer substrate, the matching capacitors, terminating resistors, and other suitable circuit elements may chip type components that are externally provided.

Also, on the bottom surface of the circuit substrate 20, the external connecting terminal electrodes 26*a*, 26*b*, 27*a*, 27*b*, and 28 for mounting the isolator 1 to a printed circuit board of a communication apparatus are provided. This reduces electrical junctions, so that outstanding reliability can be obtained with low loss. In addition, it is not necessary to provide additional terminal components. Thus, the price of the non-reciprocal circuit element can be further reduced. Since the bottom surface of the circuit substrate 20 is located at a terminal surface, the profile can be reduced.

Second Preferred Embodiment

Figure 7:
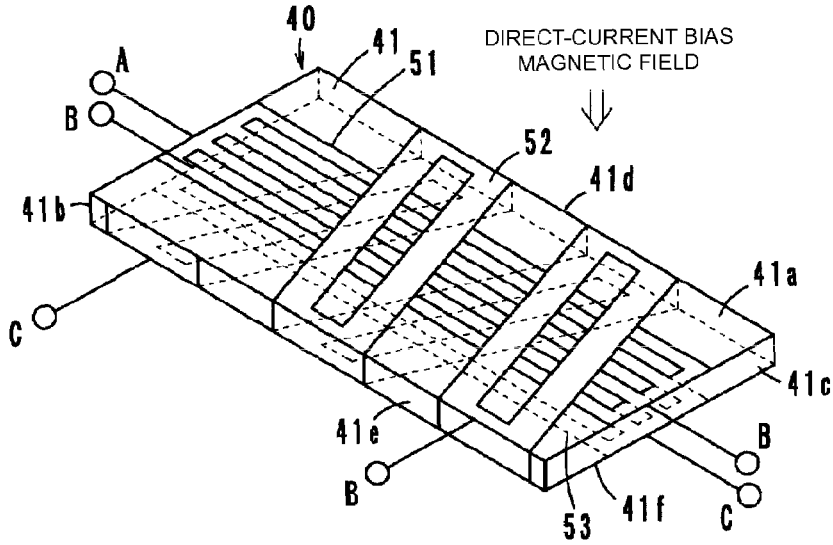
FIG. 7 is a perspective view showing a center electrode assembly in a two-port isolator according to a second preferred embodiment of the present invention.
Figure 8A:
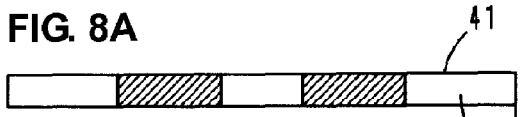
Figure 8B:
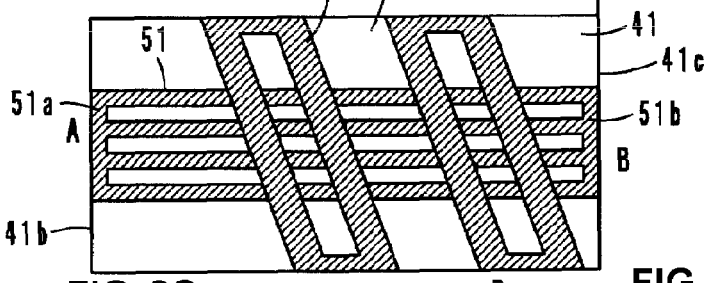
Figure 8D:
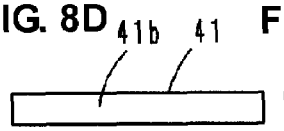
Figure 8C:
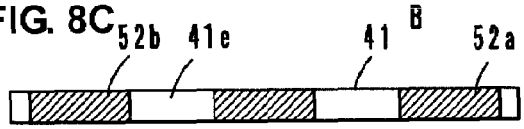
Figure 8E:
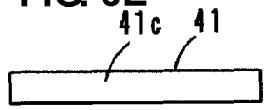
Figure 8F:
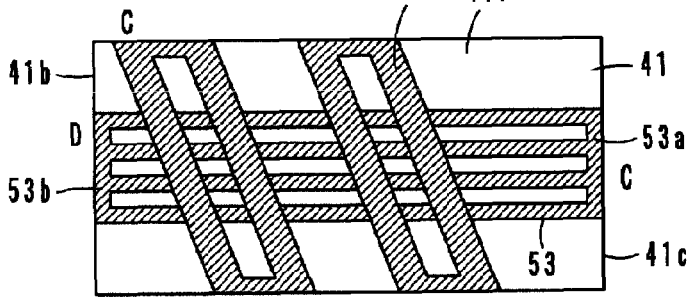
Figure 9:
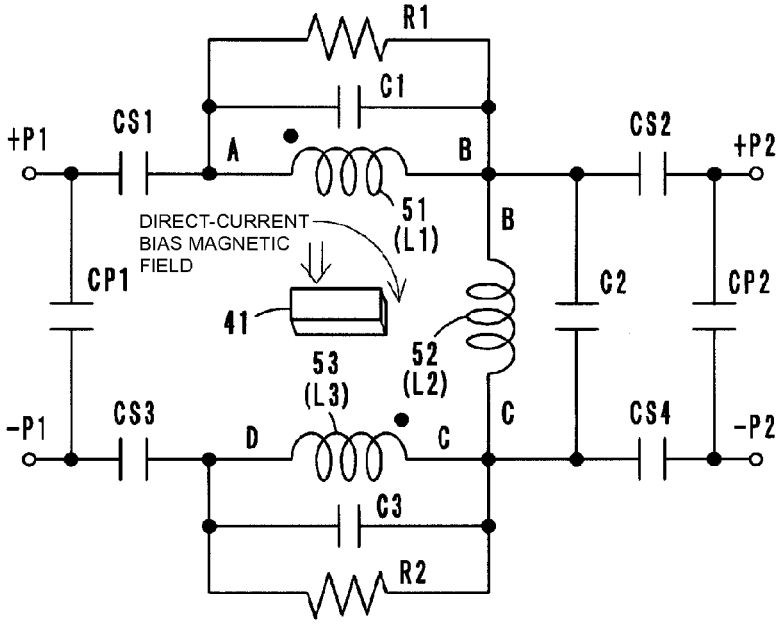
FIG. 9 is an equivalent circuit diagram of the isolator of the second preferred embodiment of the present invention.

A two-port isolator according to a second preferred embodiment of the non-reciprocal element of the present invention includes the center electrode assembly 40 shown in FIG. 7, and has the equivalent circuit shown in FIG. 9. Other features preferably are similar to those of the isolator 1 according to the first preferred embodiment.

A first center electrode 51 is longitudinally arranged on a first main surface 41*a* of a ferrite member 41, and a third center electrode 53 is longitudinally arranged on a second main surface 41*f*. The electrodes do not intersect with each other. A second center electrode 52 is wound for about two turns around the first and second main surfaces 41*a* and 41*f* in the shorter side direction thereof, and intersects with the first and third center electrodes 51 and 53 in a mutually insulated state. The second center electrode 52 may be wound for three or more turns.

Specifically, as described in detail in FIGS. 8A to 8F, the first center electrode 51 is longitudinally formed on the first main surface 41*a* of the ferrite member 41. One end 51*a* (electrode A) thereof is arranged to be exposed at a first side face 41*b*, and the other end 51*b* (electrode B) thereof is arranged to be exposed at a second side surface 41*c*. The second center electrode 52 is wound for a total of about two turns so that one end 52*a* (electrode B) of the second center electrode 52 is arranged on a fourth side surface 41*e* and the other end 52*b* (C electrode) thereof is arranged on the fourth side surface 41*e* after the second center electrode 52 is wound from the first main surface 41*a* through a third side surface 41*d*, a second main surface 41*f*, a fourth side surface 41*e*, the first main surface 41*a*, the third side surface 41*d*, and the second main surface 41*f*. The third center electrode 53 is longitudinally arranged on the second main surface 41*f*. One end 53*a* (electrode C) thereof is arranged to be exposed at the second side surface 41*c* and the other end 53*b* (electrode D) thereof is arranged to be exposed at the first side surface 41*b*.

As shown in the circuit diagram of FIG. 9, the circuit configuration is basically similar to the equivalent circuit shown in FIG. 2. Furthermore, matching capacitors CS1 to CS4 and impedance adjusting capacitors CP1 and CP2 are added.

Specifically, the capacitor CS1 is inserted between a balanced input port +P1 and an electrode A, and the capacitor CS2 is inserted between a balanced output port +P2 and an electrode B. The capacitor CS3 is inserted between a balanced input port −P1 and an electrode D, and the capacitor CS4 is inserted between a balanced output port −P2 and an electrode C. The capacitor CP1 is inserted between the balanced input ports +P1 and −P1, and the capacitor CP2 is inserted between the balanced output ports +P2 and −P2.

Another circuit configuration in the second preferred embodiment is similar to that in the first preferred embodiment, and its operation and advantages are similar to those in the first preferred embodiment. In particular, in the second preferred embodiment, the second center electrode 52 is wound for about two turns around the ferrite member 41, whereby the inductance of the second center electrode 52 is increased, more wide band input matching is obtained, and matching with a pre-stage circuit, such as a power amplifier, is facilitated.

In addition, since the matching capacitors CS1 to CS4 are inserted, even if an electric characteristic in a wide band is improved by setting the inductances of the center electrodes 51, 52, and 53 to be large, matching of an impedance (50Ω) to a device connected to the isolator is facilitated. This advantage can be achieved only by inserting either one of the capacitors CS1 and CS2, and either one of the capacitors CS3 and CS4. Further, since the impedance adjusting capacitors CP1 and CP2 are inserted, a desired harmonic, such as the second harmonic or the third harmonic, can be suppressed.

In the first and second preferred embodiments, it is preferable that an electrical length of the second center electrode 52 be substantially a quarter wavelength or a wavelength that is slightly less than the quarter wavelength. The inductance of the second center electrode 52 is significantly increased, whereby resonance can be achieved without connecting the second matching capacitor C2, thus eliminating deterioration of an insertion loss caused by the Q value of the second matching capacitor C2. Furthermore, wider band input matching is obtained, and matching with a pre-stage circuit, such as a power amplifier, is facilitated.

Third Preferred Embodiment

Figure 10:
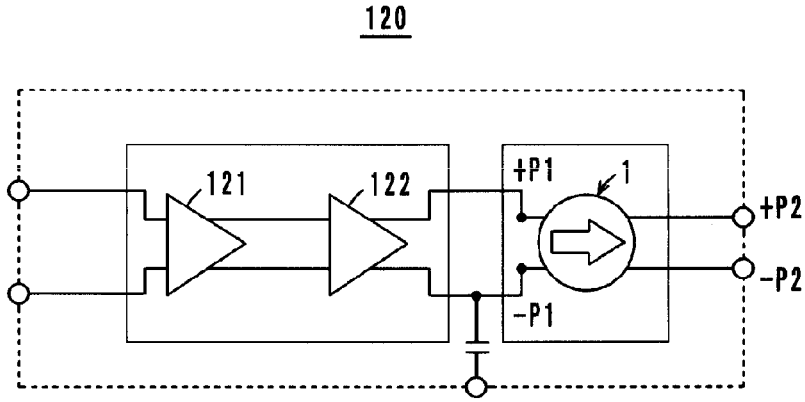
FIG. 10 is a block diagram showing an electric circuit of a composite electronic component according to a third preferred embodiment of the present invention.

FIG. 10 is a block diagram of a composite electronic component 120 in which the isolator 1 is connected to balanced amplifiers 121 and 122. With the composite electronic component 120, when viewed from an output of the balanced amplifier 122, a load impedance is constant regardless of an operating state (for example, whether or not power is supplied to the post-stage circuit, a power-supply voltage state) of a post-stage circuit, or an operating environment (for example, an ambient temperature and an operating condition of a load apparatus such as an antenna element). As a result, power load efficiencies and an output distortion characteristic of the balanced amplifiers 121 and 122 can be maintained at optimal levels.

Fourth Preferred Embodiment

Figure 11:
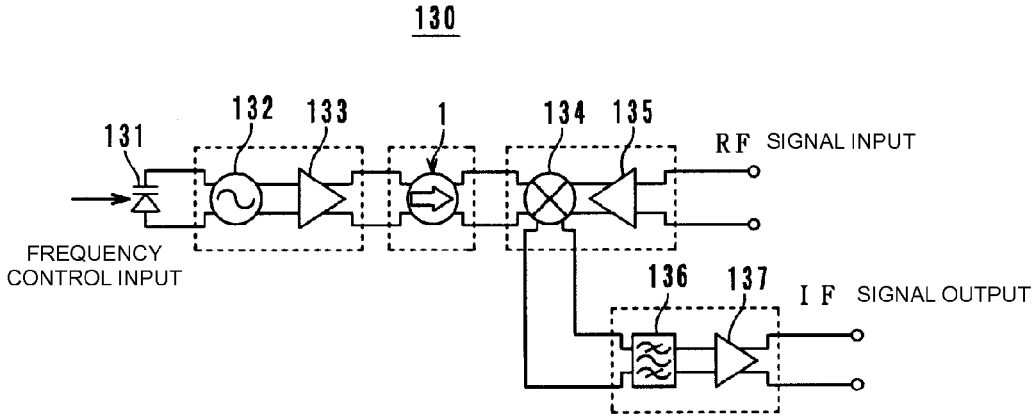
FIG. 11 is a block diagram showing an electric circuit of a composite electronic component according to a fourth preferred embodiment of the present invention.

FIG. 11 is a block diagram of a composite electronic component 130 in which the isolator 1 is inserted between a balanced oscillator 132 and a balanced frequency mixer 134. Reference numeral 131 denotes a variable capacitance diode. Reference numerals 133, 135 and 137 denote balanced amplifiers. Reference numeral 136 denotes a balanced filter (for example, a surface acoustic wave filter).

With the composite electronic component 130, when viewed from an output end of the balanced amplifier 133, a load impedance is constant regardless of operating states of the balanced frequency mixer 134 and the balanced filter 136, or an operating environment of the composite electronic component 130 itself. As a result, an oscillation frequency of the balanced oscillator 132 and output power do not vary, so that an optimal operating state is maintained. In particular, even if power for the balanced frequency mixer 134 is intermittently supplied, the oscillation frequency of the balanced oscillator 132 does not instantaneously vary.

Fifth Preferred Embodiment

Figure 12:
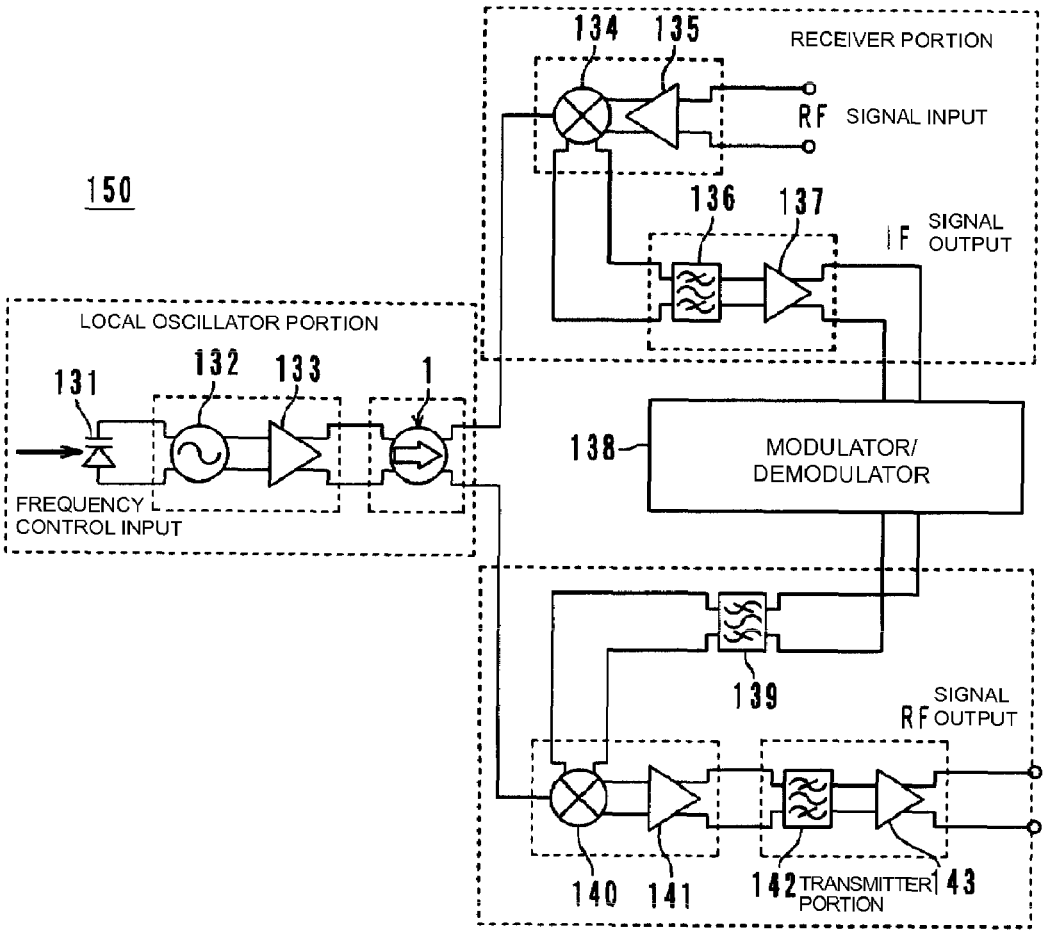
FIG. 12 is a block diagram showing an electric circuit of a communication apparatus according to a fifth preferred embodiment of the present invention.

In addition, FIG. 12 is a block diagram in which the isolator 1 is built into an RF portion of a cellular phone 150. Reference numeral 138 denotes a balanced modulator/demodulator. Reference numerals 139 and 142 denote balanced filters. Reference numeral 140 denotes a balanced frequency mixer. Reference numerals 141 and 143 denote balanced amplifiers. The balanced output port +P2 of the isolator 1 is connected to the frequency mixer 134 in a receiver portion, and the balanced output port −P2 is connected to the frequency mixer 140 in a transmitter portion.

In the cellular phone 150, an oscillation frequency of the balanced oscillator 132 does not vary, so that an optimal operating state is maintained. In particular, even if power for the frequency mixer 140 in the transmitter portion is intermittently supplied, an output of the balanced oscillator 132 that is supplied to the receiver portion does not instantaneously vary. In addition, the isolator 1 also has a function of distributing the output of the balanced oscillator 132.

The non-reciprocal circuit, composite electronic component, and communication apparatus of the present invention are not limited to the foregoing preferred embodiments, but may be modified within the scope of the present invention.

In particular, the ferrite member may have a disk shape, a hexagon, an octagon, or any other suitable shape, other than a substantially rectangular parallelepiped shape described above. In addition, the configuration of the circuit substrate 20 is optional. In the foregoing preferred embodiments, the center electrode assembly 40 preferably uses a horizontal placement in which the main surface 41*a* of the ferrite member 41 is placed substantially in parallel to the circuit substrate 20. However, a vertical placement may be used in which the main surface 41*a* of the ferrite member 41 is placed substantially perpendicularly to the circuit substrate 20. In this case, by using a pair of permanent magnets 30 to sandwich the center electrode assembly 40 from two sides, the distribution of a direct-current bias magnetic field is improved, thus easily realizing a low-loss, wide band operation.

As described above, the present invention is useful in a two-port non-reciprocal circuit element such as an isolator used in a microwave band. In particular, the present invention is superior in a simplified circuit configuration, a small insertion loss, and good reliability.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A non-reciprocal circuit element comprising:

a permanent magnet;

a ferrite member;

a plurality of center electrodes coupled in a high frequency manner with the ferrite member to which a bias magnetic field is applied by the permanent magnet; wherein the ferrite member is provided with first, second, and third center electrodes;

the first and third center electrodes do not intersect with each other, and intersect with the second center electrode in a mutually insulated state;

connection is established so that a magnetic field generated when a current flows from one end to the other end of the first center electrode, and a magnetic field generated when a current flows from one end to the other end of the third center electrode have the same phase and direction;

a first matching capacitor and a first terminating resistor are connected in parallel to the first center electrode, a second matching capacitor is connected in parallel to the second center electrode, and a third matching capacitor and a second terminating resistor are connected in parallel to the third center electrode; and one end of the first center electrode and the other end of the third center electrode define first balanced input/output ports, and the other end of the first center electrode, one end of the second center electrode, the other end of the second center electrode, and one of the third center electrode define second input/output ports.

2. The non-reciprocal circuit element according to claim 1, wherein at least the second center electrode is wound at least one time around the ferrite member.

3. The non-reciprocal circuit element according to claim 1, wherein an electrical length of the second center electrode is substantially a quarter wavelength or a wavelength slightly less than the quarter wavelength.

4. A composite electronic component comprising:

a pair of amplifiers arranged to operate with a phase difference of substantially 180°; and the non-reciprocal circuit element as set forth in claim 1 connected to outputs of the pair of amplifiers.

5. A communication apparatus comprising the non-reciprocal circuit element as set forth in claim 1.

6. A communication apparatus comprising the composite electronic component as set forth in claim 4.

* * * * *